US008181783B2

(12) United States Patent
Kakura et al.

(10) Patent No.: US 8,181,783 B2
(45) Date of Patent: May 22, 2012

(54) WET SHEET FLEXIBLE PACKAGE AND LABEL FOR THE WET SHEET FLEXIBLE PACKAGE

(75) Inventors: Yoshikazu Kakura, Osaka (JP); Akihisa Watanabe, Osaka (JP); Eiji Yamamoto, Osaka (JP); Takeshi Bandoh, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 12/740,406

(22) PCT Filed: Oct. 31, 2008

(86) PCT No.: PCT/JP2008/069925

§ 371 (c)(1), (2), (4) Date: Aug. 12, 2010

(87) PCT Pub. No.: WO2009/057766

PCT Pub. Date: May 7, 2009

(65) Prior Publication Data

US 2010/0300915 A1 Dec. 2, 2010

(30) Foreign Application Priority Data

Nov. 2, 2007 (JP) ..... 2007-285738

(51) Int. Cl.
*B65D 73/00* (2006.01)

(52) U.S. Cl. ..... 206/494; 206/812; 383/211

(58) Field of Classification Search ..... 206/210, 206/494, 233, 812, 807, 449; 221/53, 302, 221/34; 383/211, 89, 303, 62
See application file for complete search history.

(56) References Cited

U.S. PATENT DOCUMENTS

| | | | | |
|---|---|---|---|---|
| 6,113,271 | A * | 9/2000 | Scott et al. | 206/494 |
| 7,665,629 | B2 * | 2/2010 | Julius et al. | 221/63 |
| 2009/0061245 | A1 * | 3/2009 | Umeda | 428/483 |

FOREIGN PATENT DOCUMENTS

| | | | |
|---|---|---|---|
| JP | 9-156676 | A | 6/1997 |
| JP | 9-216672 | A | 8/1997 |
| JP | 10-179443 | | 7/1998 |
| JP | 2000-072160 | | 3/2000 |
| WO | WO 2007122942 | A1 * | 11/2007 |

OTHER PUBLICATIONS

International Search Report from corresponding PCT application No. PCT/JP2008/059925, dated Nov. 25, 2008, 3 pages.

* cited by examiner

*Primary Examiner* — J. Gregory Pickett
*Assistant Examiner* — Andrew Perreault
(74) *Attorney, Agent, or Firm* — Brinks Hofer Gilson & Lione

(57) ABSTRACT

The present invention relates to a wet sheet flexible package 1, including a plurality of wet sheets 2 impregnated with a liquid; a film bag 3 that is a flexible film bag packaging the plurality of wet sheets 2 and including a dispensing opening 31; and a label 5 attached to a surface of the film bag 3, covering the dispensing opening 31, and being able to be peeled off. In the wet sheet flexible package 1, when the label 5 is peeled off from the film bag 3, the dispensing opening 31 is unsealed and an adhesive layer 53 is exposed around the dispensing opening 51 on the surface of the film bag 3. A substrate 54 is provided between the adhesive layer 53 and the surface of the film bag 3, and the substrate 54 is composed of a film having a higher compression strength than a film composing the film bag 53.

3 Claims, 7 Drawing Sheets

WET SHEET FLEXIBLE PACKAGE AND LABEL FOR THE WET SHEET FLEXIBLE PACKAGE

RELATED APPLICATION

This application is a 35 U.S.C. §371 national phase filing of International Patent Application No. PCT/JP2008/069925, filed Oct. 31, 2008, through which and to which priority is claimed under 35 U.S.C. §119 to Japanese Patent Application No. 2007-285738, filed Nov. 2, 2007.

TECHNICAL FIELD

The present invention relates to a wet sheet flexible package that includes wet sheets, which are impregnated with a liquid such as a medical agent or an alcohol, and a film bag. The present invention also relates to a label for the wet sheet flexible package.

BACKGROUND ART

Conventionally, there has been known a wet sheet flexible package that includes a plurality of wet sheets and a flexible film bag. The plurality of wet sheets is impregnated with a liquid such as an alcohol, and is individually folded and stacked in the flexible film bag.

In such flexible film bag, a dispensing opening for taking out each wet sheets is provided. In addition, in order to prevent a volatilization of liquid from the dispensing opening, a self-adhesive label which hermetically covers the dispensing opening is attached to the surface of the film bag.

A use method of wet sheet flexible packages having the plurality of wet sheets packaged in the film bag is broadly categorized in the following two methods.

In a first method, a label re-attachable to the film bag is used as the above-described self-adhesive label. The dispensing opening can be opened when the self-adhesive label is peeled off from the film bag. After taking out each wet sheets stored therein through the dispensing opening, the self-adhesive label is re-attached to the original position to store the wet sheets remained in the film bag. This use method is easy and low-cost. However, since the self-adhesive label is repeatedly peeled off and reattached, the airtightness becomes lower and the wet sheets stored in the film bag tend to be dry. Moreover, since the film bag is flexible, taking out a wet sheet is not easy.

In a second method, a self-adhesive label is peeled off and a sealing member made of a synthetic resin and having an openable and closable lid for sealing the dispensing opening is attached to the surface of the film bag. After a wet sheet stored therein is taken out by opening the openable and closable lid of the sealing member, the openable and closable lid is closed again to store the wet sheets remained in the film bag. This use method hardly reduces airtightness of the openable and closable lid regardless of the frequency in use. In addition, since the sealing member is made of a synthetic resin, a wet sheet is easy to be taken out.

One example for a wet sheet flexible package used in the second use method is a wet tissue package which stores the plurality of wet tissues stacked in an enclosing bag (equivalent to the film bag according to the present invention) and whose dispensing opening is sealed with a sealing material. (for example, [0018] and other sections in Patent Document 1)

According to this wet tissue package, after the sealing material is peeled off, an adhesive remains at the upper surface of the enclosing bag. Further, a plastic molded member provided with a lid plate (equivalent to the sealing member of the present invention) is attached to the adhesive. (for example, [0030] and other sections in Japanese Patent No. 3190273). Patent Document 1: JP3190273. In the wet tissue package described therein, however, microscopic gaps tend to be generated between the attached molded member and the surface of the adhesive. Accordingly, the wet tissues stored therein tend to dry quickly by volatilizing the impregnated liquid through the generated microscopic gaps.

More specifically, the adhesive placed to the upper surface of the enclosing bag is easy to deform by following the deformation of the enclosing bag. In contrast, the plastic molded member is planar and hard to bend. Accordingly, when the molded member is pressed against the enclosing bag, the molded member is often attached to the adhesive in a state in which the enclosing bag and the adhesive are distorted in a wave-like form (winkles are generated). Therefore, the microscopic gaps are easily generated between the plastic molded member and the surface of the adhesive. When the gaps are generated, as described above, the impregnated liquid is volatilized through the gaps and the wet tissues stored therein dry quickly.

SUMMARY OF INVENTION

The present invention has an object of improving a wet sheet flexible package provided with a sealing member that includes an openable and closable lid and is attached to an adhesive layer of a film bag when the wet sheet stored therein is taken out, and providing the wet sheet flexible package that can tightly attach the sealing member to the adhesive layer without generating gaps.

The present invention includes a wet sheet flexible package comprising: a plurality of wet sheets impregnated with a liquid; a film bag that is a flexible film bag packaging the plurality of wet sheets and including a dispensing opening formed therein; a label attached to the surface of the film bag, covering the dispensing opening, and being able to be peeled off. When the label is peeled off from the film bag, the dispensing opening is opened and an adhesive layer is exposed around the dispensing opening on the surface of the film bag. A substrate is provided between the adhesive layer and the surface of the film bag, and the substrate is composed of a film having higher compression strength than a film composing the film bag.

Here, the above-described compression strength is measured in conformity with JIS P 8126.

When using the above-described wet sheet flexible package, the dispensing opening is opened by peeling off the label and the adhesive layer is exposed around the dispensing opening. The surface of the adhesive layer is pressed against the sealing member having an openable and closable lid so as to attach a back surface of the sealing member to the adhesive layer.

In the above-described wet sheet flexible package, a substrate is provided between the adhesive layer and the surface of the film bag. Since this substrate is composed of a film having the higher compression strength than the film composing the film bag, the substrate has a high rigidity compared with the film bag and is hard to deform. Therefore, when the above-described sealing member is pressed against the adhesive layer, the adhesive layer supported by the high rigidity substrate is hard to deform in the form of a wave, so that the back surface of the sealing member can be attached to the front surface of the adhesive layer without generating gaps.

According to the wet sheet flexible package to which the sealing member is attached, the wet sheets stored therein can be taken out through the dispensing opening by opening the openable and closable lid. Meanwhile, the wet sheet flexible package to which the sealing member is attached can store the wet sheets remained therein by closing the openable and closable lid. Here, since the back surface of the sealing member is attached to the front surface of the adhesive layer without generating gaps as described above, volatilization of the impregnated liquid can be prevented and the wet sheets stored therein can be maintained in wet condition over the long period.

In the wet sheet flexible package according to the present invention, it is preferable that a planner-viewed annularly shaped cut line is formed in the film bag. When the label is peeled off from the film bag, the label and a region surrounded by the planner-viewed annularly shaped cut line are detached from the film bag to unseal the dispensing opening.

In the above-described preferable wet sheet flexible package, when the label is peeled off, the region surrounded by the planner-viewed annularly shaped cut line is detached. This makes it is possible to form rather wide dispensing opening in the film bag whereby the wet sheet can be taken out easily.

The present invention includes a label covering a dispensing opening formed in a film bag that packages a plurality of wet sheets impregnated with a liquid, comprising: a laminated body in which a first substrate, a first adhesive layer, a second substrate and a second adhesive layer are sequentially laminated. The second substrate is composed of a film, having a higher compression strength than a film composing the film bag; an planner-viewed annularly shaped cut line is formed by cutting into the first adhesive layer, the second substrate and the second adhesive layer in a thickness direction; the planner-viewed annularly shaped cut line forms an annular shape large enough to surround the dispensing opening; and a region of the first substrate outside the planner-viewed annularly shaped cut line is artificially bonded to the first adhesive layer.

The above-described label for the wet sheet flexible package is attached to the front surface of the film bag with the second adhesive layer interposed inbetween, while aligning with the planner-viewed annularly shaped cut line so that the planner-viewed annularly shaped cut line surrounds the dispensing opening of the film bag.

In the laminated body composing the above-described label, the planner-viewed annularly shaped cut line is formed by cutting into the first adhesive layer; the second substrate and the second adhesive layer in a thickness direction. Further, a region of the first substrate on outside the planner-viewed annularly shaped cut line is artificially bonded to the first adhesive layer. Therefore, when the label is peeled off from the film bag, the planner-viewed annularly shaped cut line and the region of the first substrate on outside the planner-viewed annularly shaped cut line are separated from the laminated body. Thus, the first adhesive layer, the second substrate and the second adhesive layer (in sequence from the top) remain in the front surface of the film bag while surrounding the dispensing opening, thereby the first adhesive layer is exposed on the front surface of the film bag. The back surface of the sealing member is attached to the front surface of the first adhesive layer thus exposed.

The second substrate is composed of a film having a higher compression strength than the film composing the film bag. Therefore, when the sealing member is pressed against the front surface of the above-described exposed first adhesive layer, the first adhesive layer is hard to deform in the form of a wave. Accordingly, the back surface of the sealing member can be attached to the front surface of the first adhesive layer without generating gaps.

In addition, in the above-described label for the wet sheet flexible package, the planner-viewed annularly shaped cut line is formed until reaching the first adhesive layer. Therefore, when the laminated body is separated as described above, the adhesive of the first adhesive layer Can be prevented from elongating in a string-like form.

DESCRIPTION OF EMBODIMENTS

The embodiments of the present invention will be described hereinunder with reference to the drawings.

Figure 1:
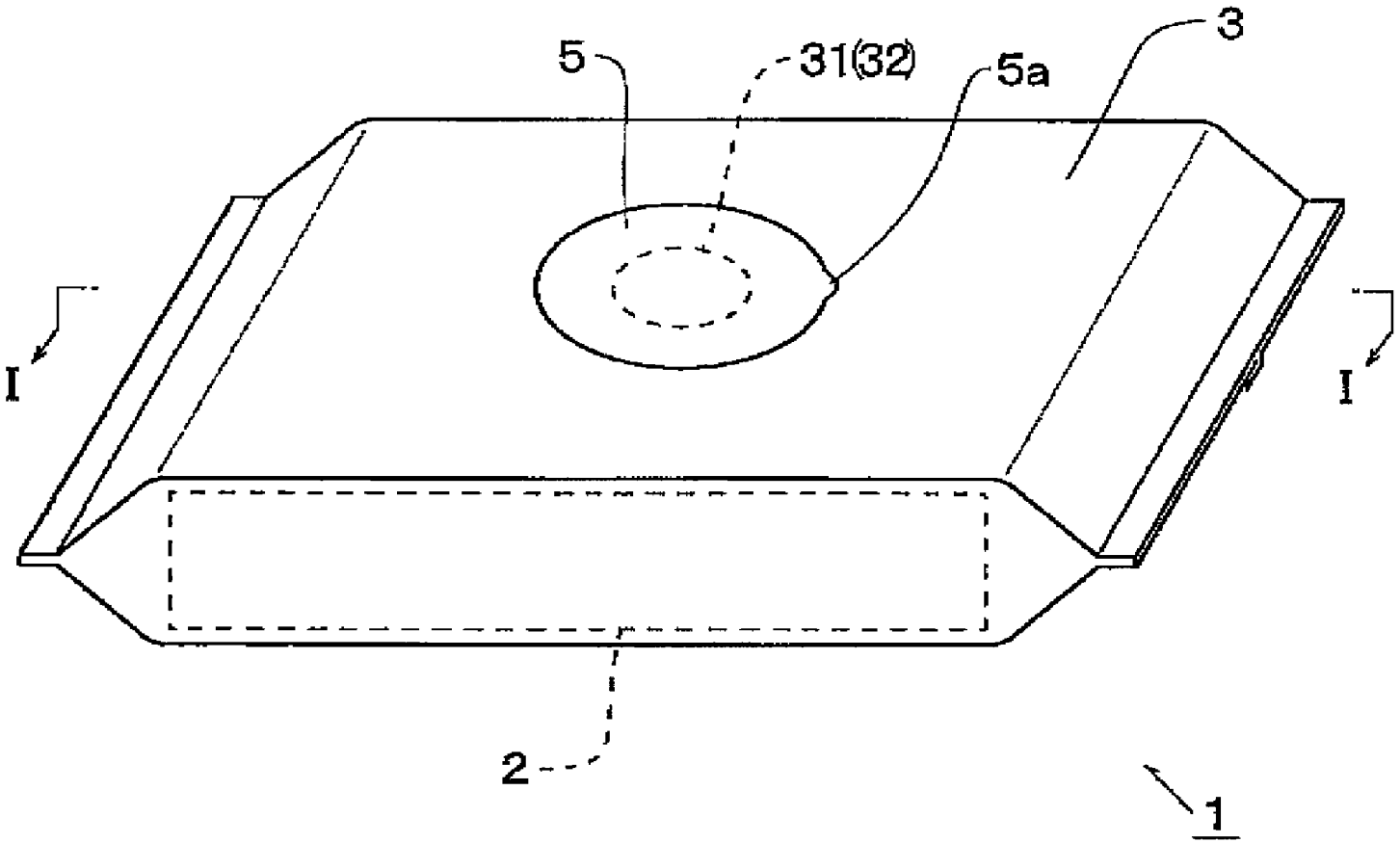
FIG. 1 is a perspective view showing one embodiment of a wet sheet flexible package according to the present invention, and viewing the flexible package from the flat side.
Figure 2:
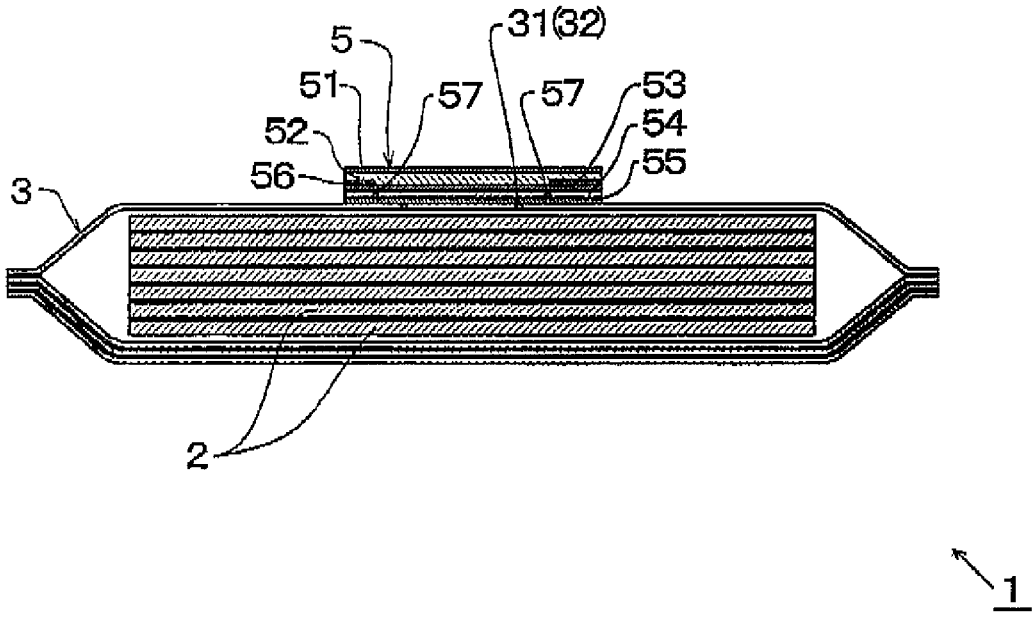
FIG. 2 is a cross-sectional view taken along the line 1-1 of FIG. 1 (a transverse cross-sectional view).

FIG. 1 and FIG. 2 show a wet sheet flexible package 1 comprising a plurality of wet sheets 2 impregnated with a liquid, a flexible film bag 3 packaging the wet sheets 2 and including a dispensing opening 31 formed therein, and a label 5 attached to the front surface of the film bag 3, covering the dispensing opening 31 and being able to be peeled off.

Figure 7:
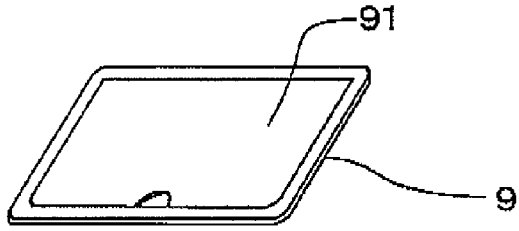
FIG. 7 is a perspective view showing a state after the label is peeled off from a wet sheet flexible package. A sealing member attached after peeling off a label is also shown.
Figure 7:
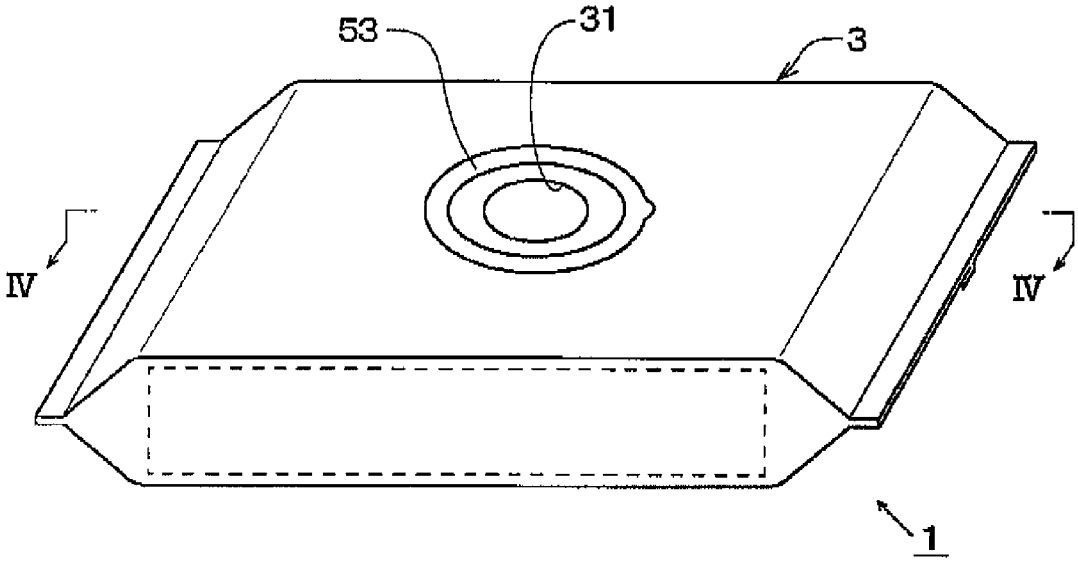
Figure 9:
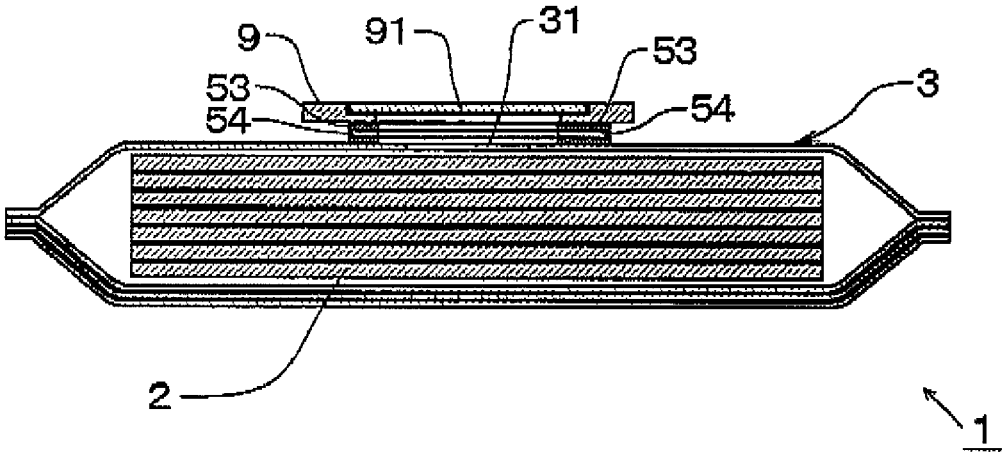
FIG. 9 is a transverse cross-sectional view showing a wet sheet flexible package in which a sealing member is attached to an adhesive layer.

As shown in FIG. 7, in this wet sheet flexible package 1, when the label 5 is peeled off, an adhesive layer 53 (a first adhesive layer 53 of the label 5) having an annularly shape is exposed on the front surface of the film bag 3. As shown in FIG. 9, when the wet sheet flexible package 1 is used, the back surface of a sealing member 9 having an openable and closeable lid 91 is attached to the adhesive layer 53 exposed as described above.

Hereinbelow, each component of the wet sheet flexible package 1 according to the present invention is specifically described.

The liquid impregnated in the above-described wet sheets 2 is not particularly limited and arbitrarily selected in accordance with its application. Examples of liquids include water, an alcohol, a surfactant, a bactericidal agent, an antibacterial agent, an antiseptic agent and a fragrance. These liquids may be used singly or in combination. Since the wet sheet flexible package 1 according to the present invention has an excellent intimate contact characteristics towards the sealing member, even when an extremely volatile liquid (for example, an aqueous solution of alcohol having an alcohol concentration of 30% or more (preferably an alcohol concentration of 50% or more)) is used, early drying of the wet sheets 2 can be prevented.

The above-described wet sheets 2 are not particularly limited as long as it has liquid-absorbing property (water absorbing property and/or oil absorbing property). For example, a nonwoven fabric, a woven fabric, a paper and a porous film containing a material having liquid-absorbing property can be used. Examples of the above-described material having liquid-absorbing property include a natural fiber such as cotton, a pulp, a synthetic fiber such as acyl type, olefin type, cellulose type and PVA type fiber (or a synthetic resin film).

The wet sheets 2 are individually folded in suitable forms, and these wet sheets are stored in the film bag 3 while multiple wet sheets are alternately stacked (in the collection of the sheets).

The film bag 3 is composed of a film having flexibility and liquid resistance. Note that, in the present invention, a film includes generally-called "sheet".

A material of the film composing the film bag 3 is not particularly limited and conventionally-known materials can be used. Typical examples include a laminate film of which a sealant layer is laminated to a base film of a laminate of metal thin films. Here, the base film includes an aluminum deposited synthetic resin film (for example, an aluminum deposited polyethylene terephthalate and the sealant layer includes a polyethylene layer.

A film thickness of the film bag 3 is usually about 30 μm to 100 μm.

The film bag 3 is formed by packaging the collection of the sheets with the film and bonding the edges of the film (for example, heat sealing) with each other. The film bag 3 is usually formed in the pillow packaging. However, the form of the packaging is not limited to the pillow packaging.

In one side of the film bag 3, the dispensing opening 31 is formed. Each of the wet sheets 2 in the collection of the sheets can be taken out from the dispensing opening 31.

In the film bag 3, the planner-viewed annularly shaped cut line 32 forms the dispensing opening 31. The dispensing opening can be unsealed by eliminating the region surrounded by the planner-viewed annularly shaped cut line 32 formed in the film bag 3.

Here, the planner-viewed annularly shaped cut line 32 indicates an edgeless cut line substantially having no edge and can be formed in any shapes such as planar-viewed circular, planar-viewed rectangle, planar-viewed triangle, and any other arbitrary shapes in addition to the planar-viewed oval as illustrated in drawings.

Further, the dispensing opening 31 is not necessarily formed by the planner-viewed annularly shaped cut line 32, and may be formed by, for example, a cut line having edges formed in the film bag 3 (for example, a planar-viewed line shaped cut line or a planar-viewed zigzag line shaped cut line) or may be composed of a drilled hole formed in the film bag 3.

The dispensing opening 31 is not particularly limited as long as it is composed of an opening or a cut line having a size large enough for the stored wet sheets 2 to be taken out.

It is preferable to apply a half-cut line (a non-penetrating cut line having V-shape line in cross section cut into the thickness direction of the film bag 3), as the planner-viewed annularly shaped cut line 32. However, the cut line 32 may be a perforated line (a cut line which is formed as a short periodic penetrating line penetrating to the thickness direction of the film bag 3 like a stitch trail made by a sewing machine) or a penetrating cut line.

Even when the cut line 32 is a perforated line or a penetrating cut line, the label 5 is attached so as to cover the dispensing opening 31 on the front surface of the film bag 3, thus the wet sheets 2 are hermetically packaged by the film bag 3.

The label 5 for the wet sheet flexible package is attached to the front surface of the film bag 3 while being able to be peeled off, so as to cover the above-described dispensing opening 31.

Figure 3:
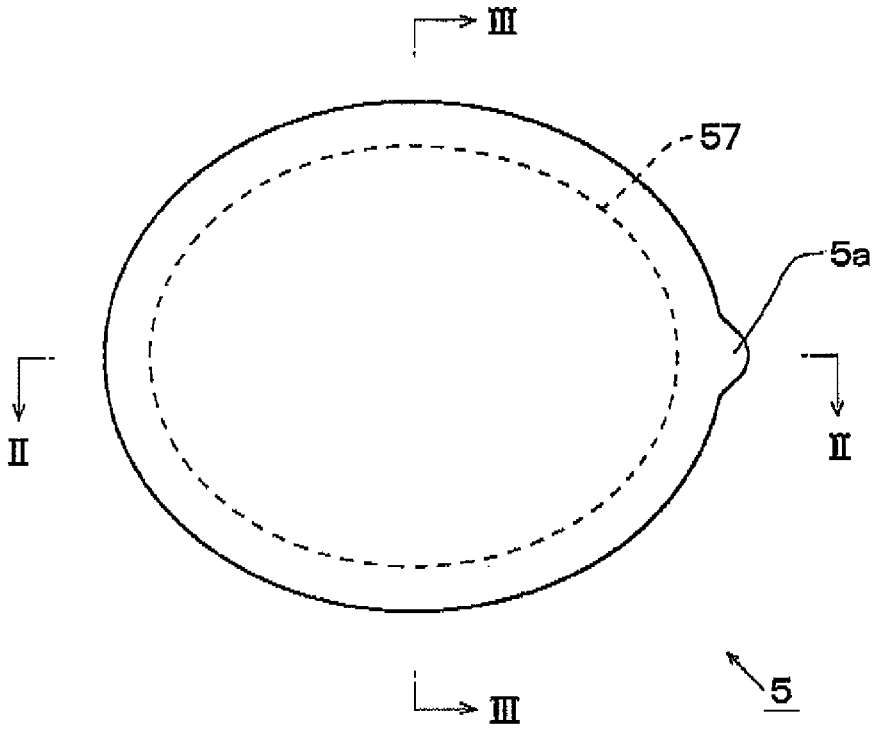
FIG. 3 is a plan view of a label.
Figure 4:
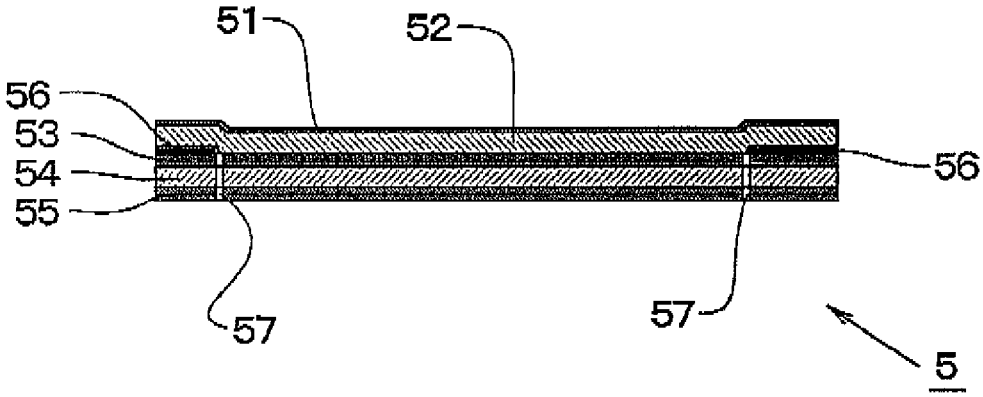
FIG. 4 is a cross-sectional view taken along the line of FIG. 3.
Figure 5:
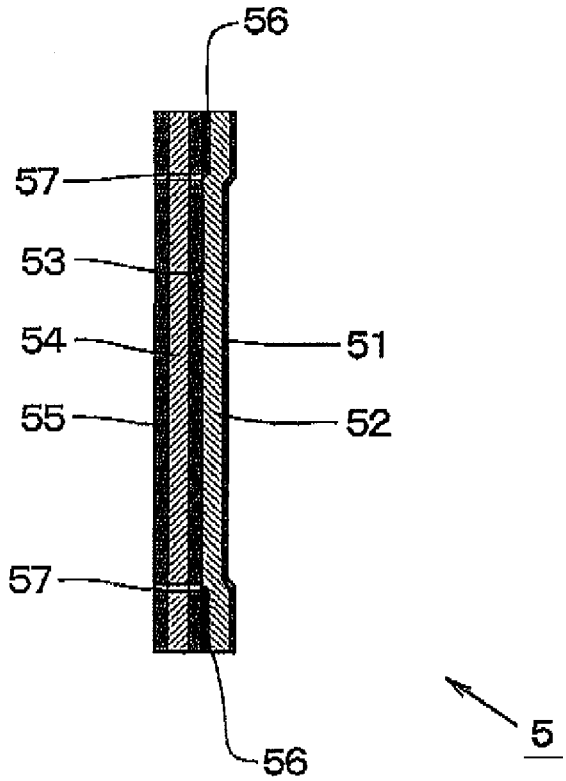
FIG. 5 is a cross-sectional view taken along the line of FIG. 3.

As shown in FIGS. 3 to 5, the label 5 forms a planar-viewed oval shaped multi-layer structure.

However, the planar-viewed shape of the label 5 is not limited to the above-described shape, and may be any shapes such as a planar-viewed circle and a planar-viewed rectangle. In addition, an edge of the label 5 is elongated. This elongated portion is used as a grip portion 5*a*.

Also, when elongating only one edge of the first substrate 52 outer than one edge of a second substrate 54, the one edge of a first substrate 52 can be used as the grip portion.

A layer structure of the label 5 has a laminated body in which a design print layer 51, the first substrate layer 52, the first adhesive layer 63, the second substrate layer 54 and a second adhesive layer 55 are sequentially laminated from the top surface to the bottom surface.

A planner-viewed annularly shaped cut line 57 is formed by cutting into the first adhesive layer 53, the second substrate layer 54 and the second adhesive layer 55 in the thickness direction.

The planner-viewed annularly shaped cut line 57 forms the annular shape large enough to surround the dispensing opening 31.

In addition, with reference to the planner-viewed annularly shaped cut line 57, a peel layer 56 is laminated on the outer side of the planner-viewed annularly shaped cut line 57 (that is) the side detached from the center of the label 5). In a region outside the planner-viewed annularly shaped cut line 57, the peel layer 56 is formed between the first substrate 52 and the first adhesive layer 53.

The first substrate 52 is not particularly limited and, for example, a synthetic resin film such as a polyester film, a film such as a paper and a synthetic paper, a laminated film made by laminating two films or more, and a laminated film made by laminating a metal deposited layer can be used.

The design print layer 51 is preferably placed on the front surface of the first substrate 52. However, the design print layer 51 may be placed on the back surface of the first substrate 52. The design print layer 51 is a layer on which a desired design is printed by the conventionally-known methods.

The second substrate 54 is composed of a film having a higher compression strength than the film composing the film bag 3. Provided that the second substrate 54 satisfies this condition, a material of a film composing the second substrate 54 is not particularly limited and a conventionally-known film can be used. The film composing the second substrate 54 is relatively selected in relation to a film composing the film bag 3. For example, a biaxial oriented polyester film such as a biaxial oriented polyethylene terephthalate, a biaxial oriented polypropylene film, a foamed polyester film, a foamed polypropylene film and a synthetic paper, may be used.

A specific value of the compression strength of a film composing the second substrate 54 is, for example, 10 N to 80 N, and preferably 20 N to 70 N. Meanwhile, a value of the compression strength of a film composing the film bag 3 is, for example, 0.2 N to 30 N.

It should be noted that the above-described compression strength is measured in conformity with JIS P 8126. According to the JIS P 8126, a test specimen is put into a circular long hole so that the test specimen is formed in a cylindrical shape, and a vertical load is applied to the specimen to measure the load at the breakage of the specimen.

In addition, it is preferable that a film composing the second substrate 54 has an excellent solvent resistance. This is because a corrosion of the second substrate 54 caused by the adhesive can be prevented when a solvent type adhesive is used as the second adhesive layer 55.

Although a thickness of the second substrate 54 varies depending on a material of the film, the thickness is usually about 30 μm to 200 μm.

The above-described first adhesive layer 53 is placed solidly on the front surface of the second substrate 54. The back surface of the first adhesive layer 53 is bonded to the front surface of the second substrate 54 with sufficient adhesion strength.

A region surrounded by the planner-viewed annularly shaped cut line 57 on the front surface of the first adhesive layer 53 is tightly bonded to the first substrate 52. Accordingly, in the region surrounded by the planner-viewed annularly shaped cut line 57, the first substrate 52 and the second substrate 54 are bonded with the first adhesive layer 53 inbetween.

The adhesion strength between the front surface of the first adhesive layer 53 and the back surface of the first substrate 52 is stronger than the adhesion strength between the back surface of the second adhesive layer 55 and the front surface of the film bag 3.

On the other hand, on the back surface of the first substrate 52, the peel layer 56 is placed on the outer side of the planner-viewed annularly shaped cut line 57. Accordingly, in the region outside of the planner-viewed annularly shaped cut line 57, the back surface of the peel layer 56 placed on the back surface of the first substrate 52 is peelably attached to the front surface of the first adhesive layer 53 facing the back surface of the peel layer 56. Also, in the grip portion 5*a*, the peel layer 56 is provided between the first substrate 52 and the first adhesive layer 53.

The peel layer 66 is a layer that can be artificially bonded to the first adhesive layer 53.

Here, "artificially bonded" indicates a state in which the layers are bonded weakly so that the layers can be peeled from each other with a slight peeling force.

The peel layer 56 is formed by applying a remover to the region from the peripheral border of the first substrate 52 to the planner-viewed annularly shaped cut line 57 on the back surface of the first substrate 52.

Examples of the removers include a solvent type or emulsion type resin solution containing silicone and ultrafine particles, an ionization radiation curing so type resin solution and a printing ink such as ultra-violet curing ink.

A thickness of the peel layer 56 is usually about 0.5 to 5 μm.

The second adhesive layer 55 is placed solidly on the back surface of the second substrate 54. The front surface of the second adhesive layer 55 is bonded to the back surface of the second substrate 54 with sufficient adhesion strength.

Various types of adhesives are applied to form the first adhesive layer 53 and the second adhesive layer 55.

An adhesive composing the first adhesive layer 53 and the second adhesive layer 55 is not particularly limited, and pressure-sensitive adhesives and the like can be used. Here, the pressure-sensitive adhesive indicates an adhesive that can instantaneously cause the adhesion under a weak pressure. Examples of materials for the pressure-sensitive adhesive include an acryl type adhesive and a rubber type adhesive.

In addition, as the above-described pressure-sensitive adhesive, a hot-melt type adhesive, a solvent type adhesive and an emulsion type adhesive can be used according to classification on property before they are applied.

The hot-melt type adhesive is an adhesive that is melt by heating so as to be applied. Usually, a hot-melt type adhesive contains a base polymer and a tackifier, and contains additives such as a wax and a stabilizer if necessary. Examples of the base polymer include an olefin type resin such as an ethylene-vinyl acetate type resin; an acryl type resin such as an ethylene-(meth)acrylic ester type resin and an ethylene-(meth) acrylic acid type resin; a thermoplastic elastomer such as styrene-butadiene-styrene block copolymer (SBS), styrene-isoprene-styrene block copolymer (SIS), styrene-ethylene-butylene-styrene block copolymer (SEBS) and styrene-ethylene-propylene-styrene block copolymer (SEAS); a synthetic rubber; and a polyester. Examples of tackifiers include a rosin type resin, a terpene type resin and a petroleum resin.

A solvent type adhesive is an adhesive which can be applied by printing such as gravure coating or using various coaters, and which is used by drying after coating. The solvent type adhesive is an adhesive in the form of a solution in which a base polymer and a tackifier (and additives, if necessary) is dissolved into an organic solvent such as toluene and ethyl acetate. Examples of the base polymer include ethylene-vinyl acetate copolymer, an acryl type resins, a thermoplastic elastomer and a synthetic rubber. Detailed description for the tackifier is descried above.

Preferably, a hot-melt type adhesive is used for the first adhesive layer 53. This is because a hot-melt adhesive remains relatively soft after it is applied. Accordingly, when the wet sheet flexible package 1 is used, the sealing member attached to the front surface of the first adhesive layer 53 tends to have good intimate contact to the front surface of the first adhesive layer 53.

A Shore A hardness of the front surface of the first adhesive layer 53 using this hot-melt adhesive is preferably about 20 to 70. The Shore A hardness means a value measured in conformity with JIS K 7215.

Adhesion strength of the first adhesive layer 53 to the back surface of the sealing member is preferably about 2N to 8N/25 mm. When the adhesion strength is too low, the sealing member may be accidentally peeled off. Meanwhile, when the adhesion strength is too high, detaching the sealing member for reuse is difficult.

As the first adhesive layer 53, it is preferable to use a hot-melt adhesive containing styrene-isoprene-styrene block copolymer (SIS) or an acryl type resin as a base polymer. This is because the hot-melt adhesive containing SIS or the acryl type resin has a high alcohol resistance and hardly decreases its adhesion strength even when used for the film bag 3 packaging the wet sheets that contains alcohol. In addition, since the hot-melt adhesive containing SIS or the acryl type resin has high adhesion characteristics towards a polypropylene molded article, the sealing member made of polypropylene can be tightly attached in good condition to the front surface of the first adhesive layer 53.

On the other hand, a solvent type adhesive is preferably used for the second adhesive layer 55. This is because the solvent type adhesive is harder than a hot-melt type adhesive after being applied. Accordingly, when the sealing member is attached to the front surface of the first adhesive layer 53 on the exposed portion, a synergetic effect of the relatively hard second adhesive layer 55 and the second substrate 54 having a high rigidity can prevent wave-shaped distortion of the first adhesive layer 53 laminated thereon.

As shown in FIG. 2, the label 5 is attached to the front surface of the film bag 3 with the second adhesive layer 55 provided inbetween, while the region surrounded by the planner-viewed annularly shaped cut line 57 aligns with the dispensing opening 31 such that the planner-viewed annularly shaped cut line 57 surrounds the cut line 32 (the dispensing opening 31) in the film bag 3.

When using the wet sheet flexible package 1, the label 5 is peeled off firstly.

To be more specific, the first substrate 52 in the grip portion 5*a* of the label 5 is picked up between fingers. Here, the peel layer 56 is interposed between the first substrate 52 and the first adhesive layer 53 in the grip portion 5*a*. Therefore, when the fingers touch the grip portion 5*a*, only the first substrate 52 is pulled up, so that the first substrate 52 of the grip portion 5*a* is easy to be picked up.

Figure 6:
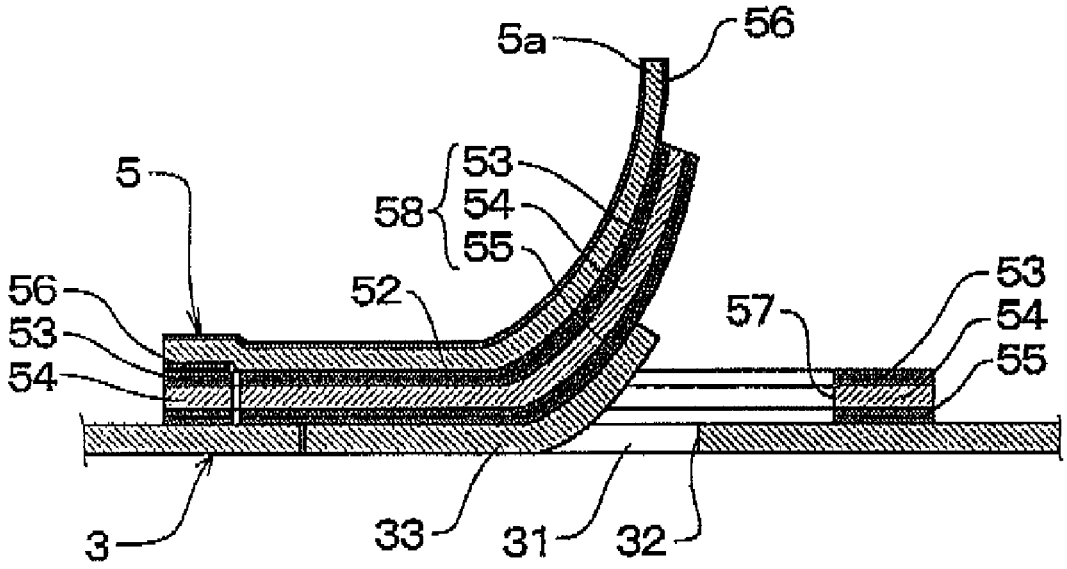
FIG. 6 is a partially omitted transverse cross-sectional view showing a halfway state of peeling off a label of a wet sheet flexible package.

As shown in FIG. 6, the label 5 is peeled off by from the grip portion 5*a*.

In the laminated body composing the label 5, the annular planner-viewed annularly shaped cut line 57 cuts into the first adhesive layer 53, the second substrate 54 and the second adhesion layer 55. Further, the peel layer 66 is placed between the first substrate 52 and the first adhesion layer 53, in a region outside the planner-viewed annularly shaped cut line 57. Accordingly, a region 58 surrounded by the planner-viewed annularly shaped cut line 57 (the region 58 surrounded by the planner-viewed annularly shaped cut line 57 in the first adhesive layer 53, the second substrate 54 and the second adhesive layer 55) is severed along the laminated body by using the planner-viewed annularly shaped cut line 57. Here, when the region 58 and the first substrate 52 bonded to each other are peeled off from the film bag 3, the region of the first substrate 52 outside the planner-viewed annularly shaped cut line 57 is peeled off from the laminated body.

The planner-viewed annularly shaped cut line is cut into the first adhesive layer 53 in the laminated body forming the above-described label 5. Therefore, when the above-described region 58 is severed along the planner-viewed annularly shaped cut line 57, the adhesive of the first adhesive layer 53 can be prevented from elongating in a string-like form.

Here, the back surface of the second adhesive layer 55 in the region 58 surrounded by the planner-viewed annularly shaped cut line 57 is attached to the region 33 surrounded by the cut line 32 in the film bag 3. Therefore, the region 33 surrounded by the cut line 32 made of, for example, a half-cut line is simultaneously pulled up when the region 58 is detached.

After the region 33 surrounded by the cut line 32 is removed, the dispensing opening 31 is opened.

Figure 8:
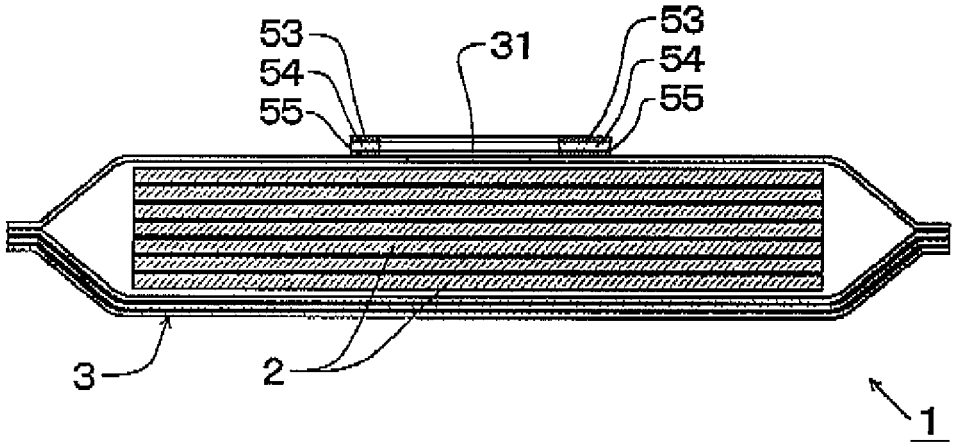
FIG. 8 is a cross-sectional view taken along the IV-IV line of FIG. 6.

As shown in FIG. 7 and FIG. 8, after the label 5 is peeled off and the dispensing opening 31 is opened as described above, the laminated body of the first adhesive layer 53, the second substrate 54 and the second adhesive layer 55 having a planner-viewed annular shape remains on the front surface of the film bag 3 by surrounding the dispensing opening 31.

Accordingly, the first adhesive layer 53 having the planner-viewed annular shape is exposed around the dispensing opening 31 on the front surface of the film bag 3.

The back surface of the described sealing member 9 is attached to the surface of the first adhesive layer 53 thus exposed.

In the sealing member 9, the opening portion is formed at the center part of a plate member whose back surface is flat, and the openable and closeable lid 91 is placed on the opening portion. A size of the opening portion is sufficiently large to take out respective wet sheets. The openable and closeable lid 91 is attached to the sealing member 9 through a hinge part and the like, and the opening portion of the sealing member 9 can be airtightly closed by making the openable and closeable lid 91 in the closed state.

A material of the sealing member 9 is not particularly limited, and a synthetic resin, a metal and the like can be exemplified. Generally, the sealing member 9 is made of a synthetic resin such as polypropylene.

The back surface of the sealing member 9 is bonded to the front surface of the first adhesive layer 53 by pressing the back surface of the above-described sealing member 9 against the front surface of the first adhesive layer 53.

The second substrate 54 made of a film having higher compression strength than a film composing the film bag 3 is provided in the lower part of the first adhesive layer 53. Accordingly, the first adhesive layer 53 supported by the second substrate 54 having a high rigidity hardly deforms in the form of a wave when the above-described sealing member 9 is pressed against the first adhesive layer 53. Therefore, the back surface of the sealing member 9 can be attached to the front surface of the first adhesive layer 53 without generating gaps (see FIG. 9).

According to the wet sheet flexible package 1 to which the above-described sealing member 9 is attached, wet sheets 2 can be taken out through the dispensing opening 31 after opening the openable and closeable lid 91. Meanwhile, the wet sheets 2 can be stored by closing the openable and closeable lid 91. Since the back surface of the sealing member 9 is attached to the front surface of the first adhesive layer 53 having a planer-viewed annular shape and surrounding the dispensing opening 31 without generating the gaps, the volatilization of the impregnated liquid through the gaps between the sealing member 9 and the film bag 3 can be prevented. Thus, the wet condition of the wet sheets 2 can be maintained over the long period.

After all of the wet sheets 2 stored in the wet sheet flexible package 1 are used, the above-described sealing member 9 can be peeled off from the wet sheet flexible package 1 so that the sealing member 9 is reused for a new wet sheet flexible package 1.

Figure 10:
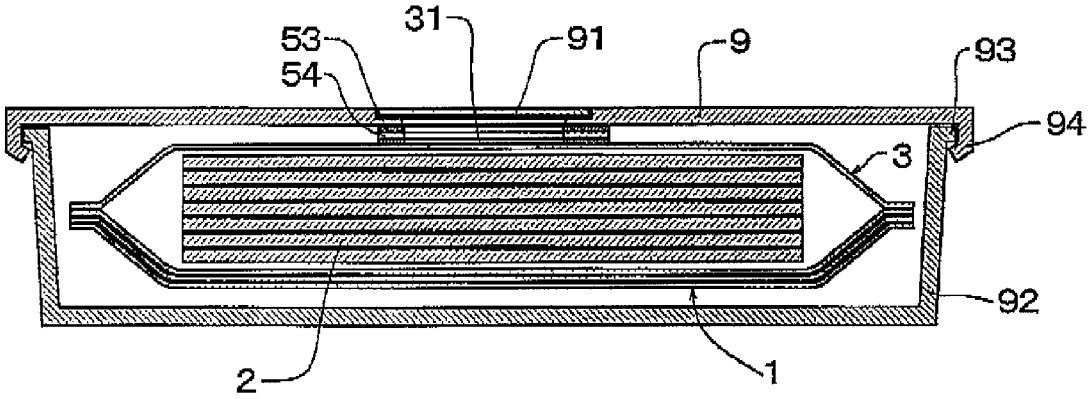
FIG. 10 is a transverse cross-sectional view showing another example of a usage for a wet sheet flexible package.

Note that, although the above-described sealing member 9 is made of a flat plate, for example, a sealing member 9 having the openable and closeable lid 91 may be formed as a lid of the container 92, as shown in FIG. 10. In the sealing member 9 in this example, a fitting part 94 fitting into a flange part 93 of the container 92 is formed at the fringe of the flat plate. Here, the back surface of the flat plate is flatly formed and the size of the flat plate is large enough to cover the opening portion of the container 92 so as to close the opening. The container 92 has a form of a concave having sufficient capacity to contain the entire wet sheet flexible package 1. The flange part 93 is formed at the fringe of the opening.

Similar to the above-described embodiment, in this example, the sealing member 9 is attached to the back surface of the first adhesive layer 53 and thereafter fitted onto the container 92.

Further, in the above-described embodiment, the label 5 for the wet sheet flexible package according to the present invention has the laminated body in which the first substrate 52, the first adhesive layer 53, the second substrate 54 and the second adhesive layer 55 are sequentially laminated, and the planner-viewed annularly shaped cut line 57 is cut into the first adhesive layer 53, the second substrate 54 and the second adhesive layer 55 in the thickness direction. However, the planner-viewed annularly shaped cut line 57 may cut only into the second substrate 54 and the second adhesive layer 55 in the thickness direction (without cutting into the first adhesive layer 53).

Moreover, as another embodiment, the label 5 for the wet sheet flexible package according to the present invention may have a laminated body in which the first substrate 52, the first adhesive layer 53, the second substrate 54, and the second adhesive layer 55 are sequentially laminated, and the planner-viewed annularly shaped cut line 57 may cut into a part of the first substrate 52, the first adhesive layer 53, the second substrate 54 and the second adhesive layer 55 in the laminate in the thickness direction.

Figure 11:
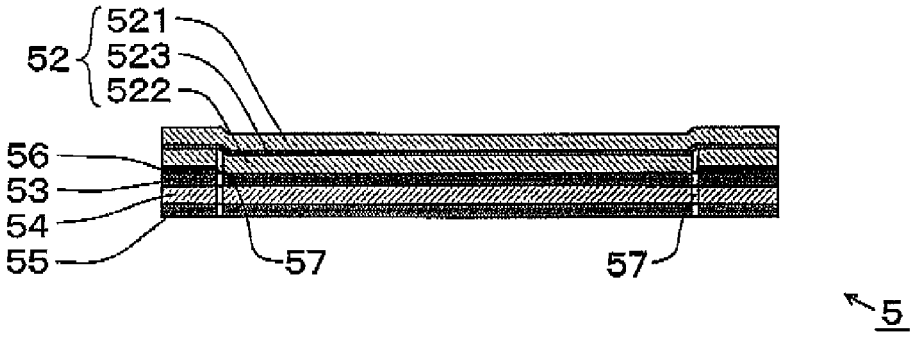
FIG. 11 is a cross-sectional view of a label related to another embodiment.

More specifically, as shown in FIG. 11, the laminated body composing the label 5 includes the first substrate 52, the first adhesive layer 53, the second substrate 54 and the second adhesive layer 55. Here, the first substrate 52 comprises a laminated film including at least two layers of an upper film layer 521 and a lower film layer 522. An adhesive layer 523 is placed between the upper film layer 521 and the lower film layer 522, and the upper film layer 521 and the lower film layer 522 are bonded to each other by the adhesive layer 523, thereby forming a united body. In addition, the design print layer (not illustrated in the drawings) may be placed on the front surface of the lower film layer 522. Alternatively, the design print layer may be placed on the back surface or the front surface of the upper film layer 521.

The planner-viewed annularly shaped cut line 57 is formed by cutting into the lower film layer 522 of the first substrate 52, the first adhesive layer 53, the second substrate 54 and the second adhesive layer 55 in the thickness direction.

In the label 5 as described above, the planner-viewed annularly shaped cut line 57 is formed up to a part of the first substrate 52 through the first adhesive layer 53. Accordingly, the first adhesive layer 53 is surely severed in the thickness direction by the planner-viewed annularly shaped cut line 57. Thus, the adhesive of the first adhesive layer 53 can more surely be prevented from elongating in a string-like form, when the above-described region 58 is severed along the planner-viewed annularly shaped cut line 57.

The label 5 of the above-described another embodiment can be produced, for example, according to the method described below.

The second adhesive layer 55 is formed by applying an adhesive to the back surface of the second substrate 54. The first adhesive layer 53 is formed by applying an adhesive to the surface of the second substrate 54. Meanwhile, the peel layer 56 having an annular shape is formed by applying a remover to a predetermined region on the back surface of the lower film layer 522 being a part of the first substrate 52. The back surface of the lower film layer 522 on which the peel layer 56 is formed is placed on and bonded to the first adhesive layer 53 formed on the surface of the second substrate 54. Thus, the laminated body is obtained. Then, by using a cutter or the like, a planner-viewed annularly shaped cut line 57 is formed from the surface of this lower film 552 (or the back surface of the second adhesive layer 55) of the laminated body, while cutting approximately along the inner edge of the peel layer 56. This planner-viewed annularly shaped cut line 57 cut into the entire laminated body in the thickness direction. Finally, the upper film layer 521 is bonded to the surface of the lower film layer 522 with providing the adhesive layer 523 inbetween. Thus, the label 5 having a layer structure shown in FIG. 11 can be produced.

This method is preferable since the planner-viewed annularly shaped cut line 57 can be easily formed.

The entire contents of Japanese Patent Application No. 2007-285738 filed on Nov. 2, 2007 are incorporated herein by reference.

As mentioned above, according to the wet sheet flexible package of the present invention, the adhesive layer exposed on the surface of the film bag is supported by the substrate which is hard to deform compared with the film bag. Therefore, the gaps between the adhesive layer exposed on the surface of the film bag and the sealing member are hardly generated, and the volatilization of the impregnated liquid through the gaps between the sealing member and the adhesive layer can be prevented.

According to the wet sheet flexible package of the present invention, after the label is peeled off and the sealing member is attached again, the wet condition of the wet sheets can be maintained over the long period.

In addition, according to the label used for the above-described wet sheet flexible package of the present invention, the wet sheet flexible package can be obtained by using the label thereto, which the wet condition of the wet sheets can be maintained over the long period.

The invention claimed is:

1. A wet sheet flexible package, comprising:

a plurality of wet sheets impregnated with a liquid;

a film bag that is a flexible film bag packaging the plurality of wet sheets and including a dispensing opening;

an adhesive layer provided on the surface of the film bag surrounding the dispensing opening; and a label attached to a surface of the film bag, covering the dispensing opening, and being able to be peeled off; wherein when the label is peeled off from the film bag, the dispensing opening is unsealed and an adhesive layer is exposed surrounding the dispensing opening on the surface of the film bag, a substrate is provided between the adhesive layer and the surface of the film bag, and the substrate is composed of a film having a higher compression strength than a film composing the film bag.

2. The wet sheet flexible package according to claim 1, wherein a planner-viewed annularly shaped cut line is formed in the film bag, and, when the label is peeled off from the film bag, the label and a region surrounded by the planner-viewed annularly shaped cut line are detached from the film bag and the dispensing opening is unsealed.

3. A label covering a dispensing opening formed in a film bag that packages a plurality of wet sheets impregnated with a liquid, comprising:

a laminated body in which a first substrate, a first adhesive layer, a second substrate and a second adhesive layer are sequentially laminated, wherein the second substrate is composed of a film having higher compression strength than a film composing the film bag;

a planner-viewed annularly shaped cut line is formed by cutting into the first adhesive layer, the second substrate and the second adhesive layer in a thickness direction;

the planner-viewed annularly shaped cut line forms an annular shape large enough to surround the dispensing opening;

a region of the first substrate outside the planner-viewed annularly shaped cut line is artificially bonded to the first adhesive layer; and an annular region of the first substrate outside the planner-view annularly shaped cut line that is artificially bonded to the first adhesive layer is releasably bonded to an annular portion of the first adhesive layer which is adhered to the second substrate.

* * * * *